United States Patent [19]

Völkle

[11] Patent Number: 4,712,835

[45] Date of Patent: Dec. 15, 1987

[54] CHAIR WITH SEAL SPRING MECHANISM

[76] Inventor: Rolf Völkle, Siemensstrasse 2, D-7298 Lossburg, Fed. Rep. of Germany

[21] Appl. No.: 919,263

[22] PCT Filed: Sep. 20, 1985

[86] PCT. No.: PCT DE/00325

§ 371 Date: Sep. 12, 1986

§ 102 Date: Sep. 12, 1986

[87] PCT Pub. No.: WO86/03954

PCT Pub. Date: Jul. 17, 1986

[30] Foreign Application Priority Data

Jan. 12, 1985 [DE] Fed. Rep. of Germany ..... 3500932

[51] Int. Cl.[4] ..... A47C 3/00

[52] U.S. Cl. ..... 297/304; 297/301; 297/349

[58] Field of Search ..... 297/304, 301, 337, 345, 297/349, 353, 338

[56] References Cited

U.S. PATENT DOCUMENTS 3,322,460 5/1967 Lellerman ..... 297/338
4,240,663 12/1980 Locher ..... 297/338 X
4,529,247 7/1985 Stumpf ..... 297/301

FOREIGN PATENT DOCUMENTS 820475 11/1951 Fed. Rep. of Germany ..... 297/349
340976 10/1959 Switzerland ..... 297/304
1256388 12/1971 United Kingdom ..... 297/304

*Primary Examiner*—James T. McCall
*Attorney, Agent, or Firm*—Spencer & Frank

[57] ABSTRACT

A chair, especially for children and teenagers, comprising a seat, a plurality of substantially horizontal legs provided with casters, a supporting frame and a backrest attached to the frame. The supporting frame is disposed close to the floor at a distance determined by the heights of the horizontal legs and the casters. A horizontal support arm is adjustably mounted on the supporting frame for support of the seat through a horizontal shaft pivotably mounted on the support arm and a tiltable seat support member, the seat support member being rotatable about the shaft through a predetermined swivel angle. A spring mechanism is disposed substantially horizontally along a tension axis, and has one end attached to a radial arm secured to the horizontal shaft and the other end to the support arm. The spring mechanism suppresses the tilting of the seat support member when the swivel angle is decreased and stimulates the tilting of the seat support member when the swivel angle is increased. A pre-stressing nut is also provided for prestressing the helical tension spring in order to adjust the swivel angle to a predetermined middle range.

18 Claims, 10 Drawing Figures

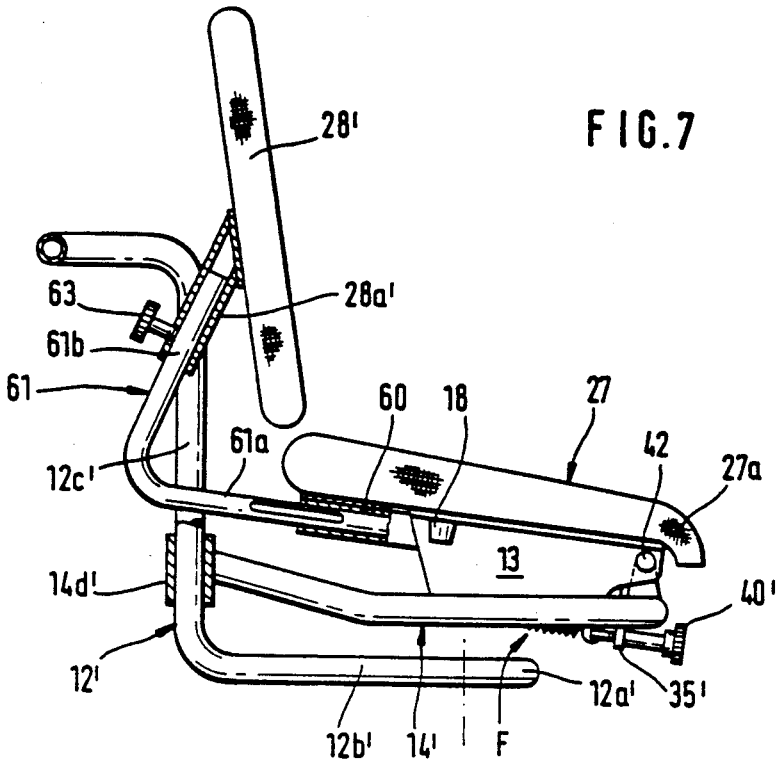
FIG.7
FIG.8
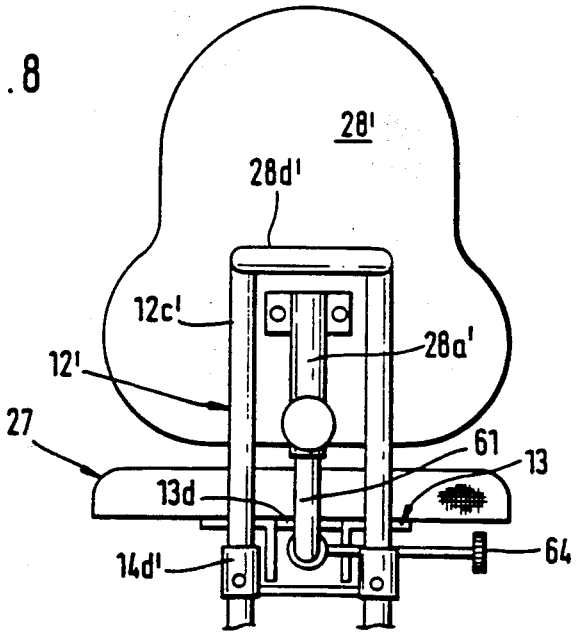

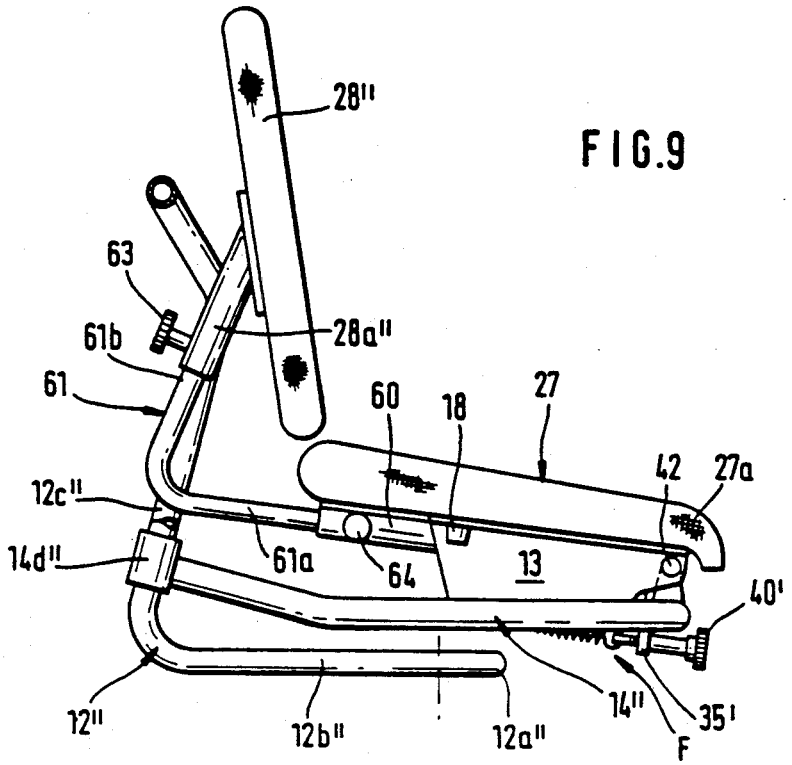
FIG.9
FIG.10
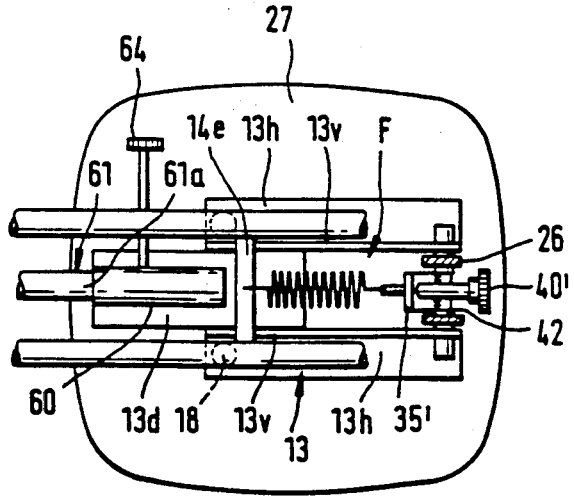

CHAIR WITH SEAL SPRING MECHANISM

BACKGROUND OF THE INVENTION

This invention relates to a chair, or sitting furniture, particularly one for children or teenagers, which comprises a seat, a back-rest, a supporting frame resting on the floor via approximately horizontal base legs, a support arm mounted on the supporting frame and a horizontal shaft secured to the support arm in the area of the seat designated for knee support; further, it comprises a pivotable seat support member connected to the support arm by means of the shaft, and a spring mechanism secured to the arm and to the seat support member, the support mechanism being adapted to suppress the pivotal motion of the seat support member when its angle of tilting, as limited by detents decreases, and to stimulate the pivotal motion when the angle increases.

In a known chair of the above discussed type (Swiss Pat. No. 592 429) the spring is an auxiliary means for adjusting the inclination of the seat as desired, the inclination being fixed by means of a device locks the tiltable seat support member with the non-tiltable support arm. While the inclination is adjusted, the seat tilts in one direction due to the user weight and in the other direction due to the return action of a pneumatic spring, the casing of which is pivotably secured to the supporting frame at the lower end and to the seat support member at the upper end. The pivot axis being situated in the direct vicinity of the knee-support area of the seat has the advantage that even in case of a stronger tilting of the seat, the user's feet are not lifted from the floor. The seat angle can be fixed in a selected position by means of the pneumatic spring.

It is also known, in a chair without the provision of a variable seat inclination, to install a helical spring substantially horizontally between the seat support member and the support arm so that the user can sit down relatively "softly" as the seat support member is brought to rest on the arm when the helical spring is compressed to its maximum. It is possible to provide a gradual progression of the springing action through a variable pre-stress setting of the compressed spring (German GM No. 84 01 116.5=German Pat. No. 34 01 314.8). From the same specification (embodiment of FIGS. 7–10) it is also known to substitute the pivot shaft by a pre-stressable torsion bar whereby a limited pivotal motion of the seat support member against the support arm is permitted. The torsion bar suppresses the tilting of the seat support member when the pivot angle decreases and stimulates the tilting when the angle increases. It should be noted that the characteristic curve of a reasonably priced torsion bar is strongly progressive. Therefore, when the user is seated, only very restricted rocking motion through an active displacement of the centre of gravity, i.e., a further decrease of the pivot angle is possible, which essentially holds true for springs with strongly progressive characteristic curves. (see torsion bars in German AS No. 1429404 and German OS No. 1943633).

The object of the invention is to provide a chair of the above discussed art without considerable additional technical input, such that the user, on one hand, can effect a substantial tilting of the seat by relatively small displacement of the centre of gravity, and, on the other hand, involuntary tilting is avoided to a large degree wherein such a tilting motion corresponds to a rocking motion and thereby, the natural restlessness of a young chair user is taken into account.

SUMMARY OF THE INVENTION

According to the invention, the support arm is mounted adjustably at a variable height on the support frame which extends behind the seat, and the spring mechanism is provided with an energy accumulator which is constituted by at least one helical spring (tension spring, leg spring) which is loaded exclusively by tensile force or torque, the pre-stressing of the accumulator being adjustable depending on the user's weight so that the seat which is inclined rearward at a minimum pivot angle is maintained in suspension by the spring mechanism in a medium range of the pivot angle.

The claimed combination results in a simple way of changing the spatial relationships between the seat back and the seat portion in the vertical as well as in the horizontal direction so that, if the proper position is set, the back rest is able to form an anatomically configured, high external axis of stability for the back during the decisive growth phase of children and youths during which the spine is profiled and formed. If, in the chair according to the invention, the back rest and seat are uniformly adjusted downwardly or upwardly, the available seating surface changes accordingly. The physiological upper leg length which has its maximum when the back rest and seat are in the uppermost position, is shortened to a minimum physiological upper leg length in the lowermost position.

The provision of the supporting frame behind the seat, thus outside a vertical plan view of the seat, in conjunction with a preferably horizontal arrangement of the spring mechanism, enables the use of relatively large helical springs, the loading capacity of which need not be fully utilized. In this manner there arises, on the one hand, a possibility of an extremely deep lowering of the seat, and, on the other hand, a spring mechanism with essentially linear characteristic. In this respect, the chair can be adjusted to fit, e.g., children 4–6 years old (FIG. 2), and also teenagers 13–16 years old and adults (FIG. 1). The diversified tilting motion requirements, dependent on the body weight and temperament of the user can be met individually through a corresponding pre-stressing of the helical spring. With relatively strong pre-stressing, the seat supporting member is maintained in suspension by the spring mechanism at the upper limit of the middle range of the pivot angle, the seat inclination being relatively small; involuntary rocking motions are avoidable essentially more easily at the high pre-stressing than at a low pre-stressing of the helical spring which results in a comparatively high inclination of the seat backwards. The space accommodating the spring mechanism is sufficiently large for helical springs of various lengths and strengths, particulary also those with diversified characteristics ("hard" or "soft" helical springs) to be installed alternatively therein. It is possible to effect, if desired, relatively large tilting by small discretionary displacements of the centre of gravity.

A simple pre-stressing device for the helical spring is provided by one embodiment.

In another embodiment, the back-rest of the chair forms a tilting unit with the seat support member, whereby the chair becomes, so to speak, a rocker.

BRIEF DESCRIPTION OF THE DRAWINGS

FIGS. 7 and 8 show another embodiment of the chair, without pedestal, in side view and rear view, FIG. 9 is a further embodiment of the chair in a view corresponding to that of FIG. 8, and FIG. 10 shows the seat support member of FIGS. 7, 8, and 9 in a bottom view.

DESCRIPTION OF THE PREFERRED EMBODIMENTS

Figure 1:
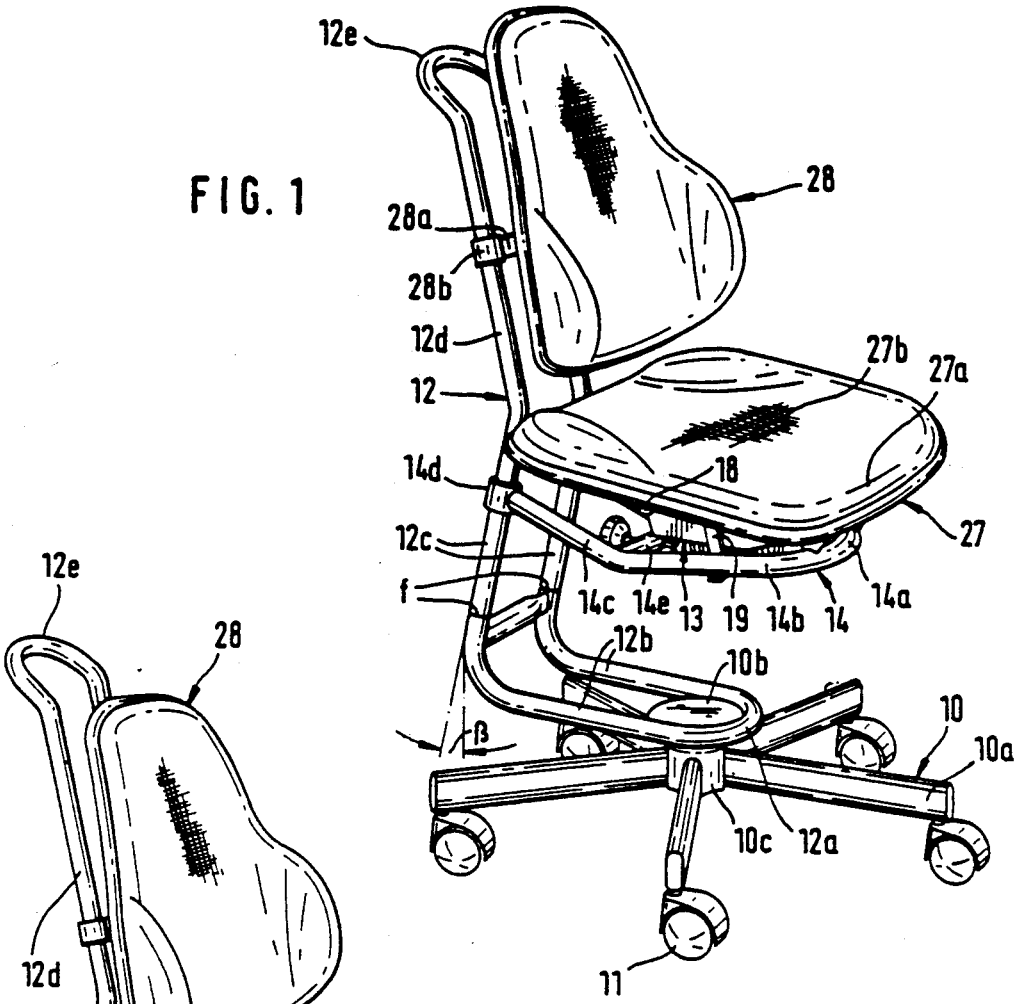
FIG. 1 shows a perspective view of the chair as adjusted for a young person of 13 years or more and for an adult.
Figure 2:
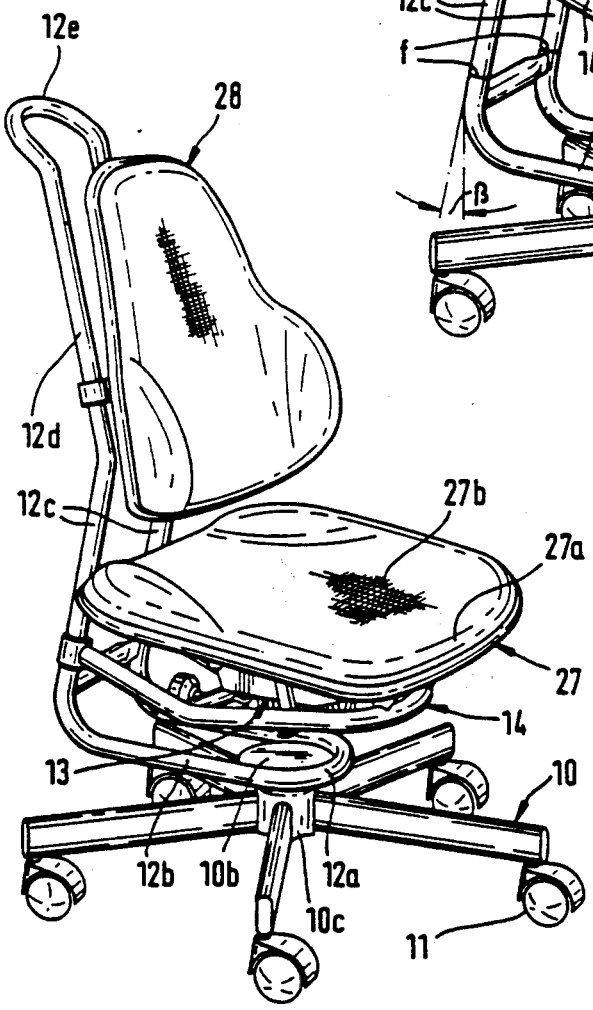
FIG. 2 shows the chair of FIG. 1 as adjusted for children about 4–6 years of age.

Referring first to the FIGS. 1–10, the chair comprises an upholstered (padding 27*b*) seat shell 27, a back-rest 28, and a supporting frame 12 resting on the floor through horizontal base legs 10. In the graphically represented embodiment, the supporting frame extends behind the seat shell 27 so that the latter can be adjusted to a very low position as shown in FIG. 2. The supporting frame 12 is made of a curved tube having two tubular stems disposed symmetrically to the vertical plane of symmetry b—b (FIGS. 5, 6) and joined together through a lower cross-member 12*a* and an upper cross-member 12*e*. The lower member 12*a* is fixed to a disc 10*b* of corresponding radius. The disc 10*b* has a concentric, vertical pivot which is rotatably supported in a pivot bearing 10*c* of the pedestal, which, in turn, consists of radially disposed legs 10 with casters 11. The tubular stems of the lower horizontal portion 12*b* of the supporting frame 12 are bent at a sector angle greater than 90° and extend into a linear adjustment portion 12*c* which, therefore, forms an acute angle $\beta$ (FIG. 1) with the vertical. A substantially horizontal support arm 14 is secured to the adjustment portion 12*c* and is vertically adjustable thereon. The arm constitutes a support for the seat shell 27.

To the adjustment portion 12*c* carrying the seat 27, is secured a straight adjustment portion 12*d* carrying the back-rest 28 and inclined against the portion 12*c*. The back-rest is secured to the tubular stems of the portion 12*d* by means of sliding bushing joints 28*b* and can be locked in a position on that portion. For manufacturing reasons, the supporting frame 12 is made of two arcuate (loop-shaped) parts, the tubular stems of which are interconnected telescopically at the lower end of the adjustment portion 12*c*. The tubular stems of the arm 14, extending into one another through the cross-member 14*a*, comprise bushing-side portions 14*c* sloped backward and upward and cross-member-side portions 14*b* sloped forward and upward, as shown particularly in FIG. 3. The inclination angle of the portions 14*c*, 14*b* is approximately the same, about 5–10°.

Figure 3:
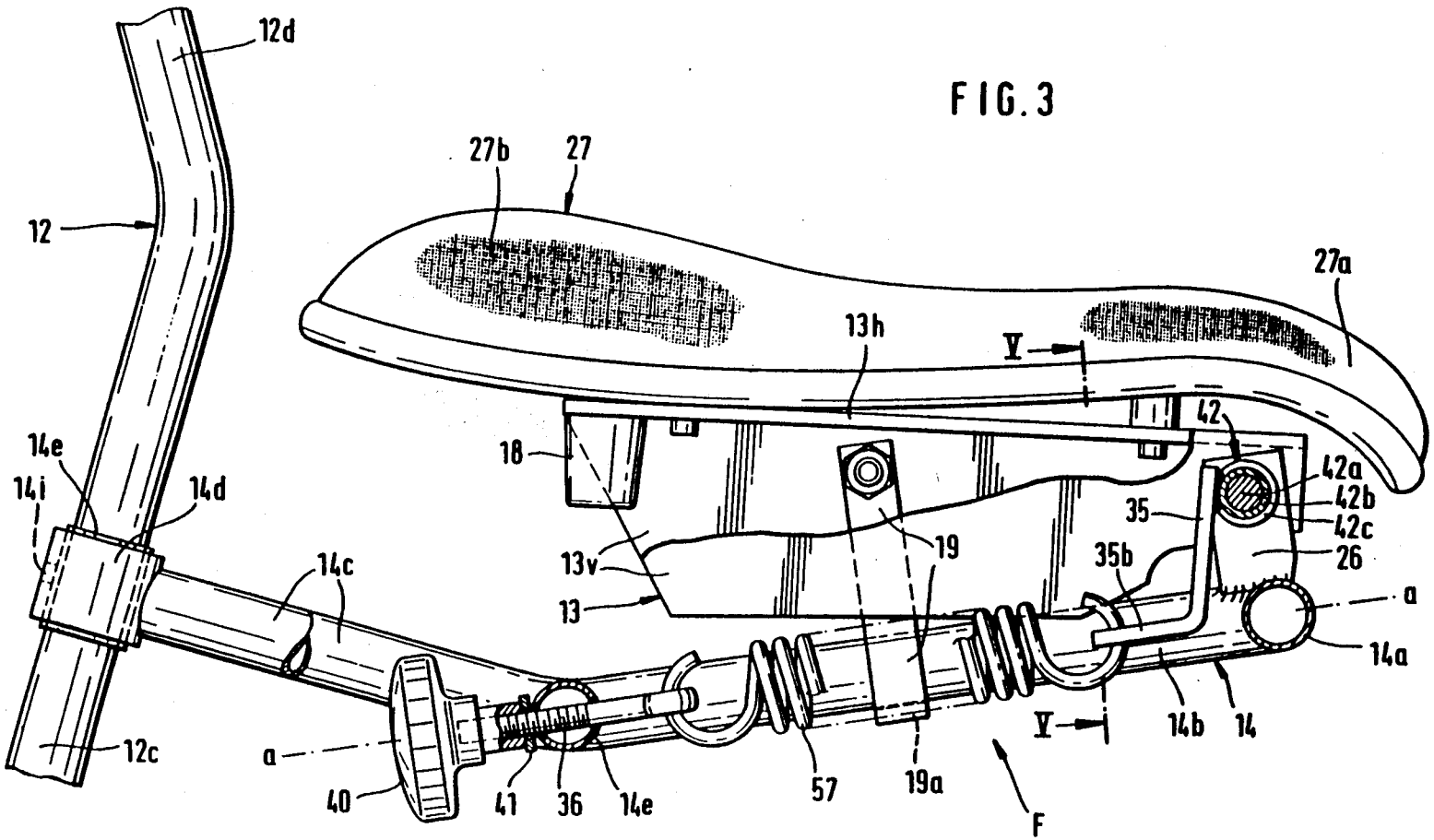
FIG. 3 is an enlarged cutaway portion of a cross-section of the chair, taken in a vertical plane of symmetry.

FIG. 3 illustrates the way the bushing joints 14*d* and the similar bushing joints 28*b* of the fastening elements 28*a* are retained on the respective tubular stems of the supporting frame 12. The bushings 14*d*, 28*b* are each lined with a plastic sleeve 14*e* and provided with a set-screw 14*i*. The sleeve can be deformed by turning the screw and thus pressed against the surface of the respective tubular stem.

Figure 4:
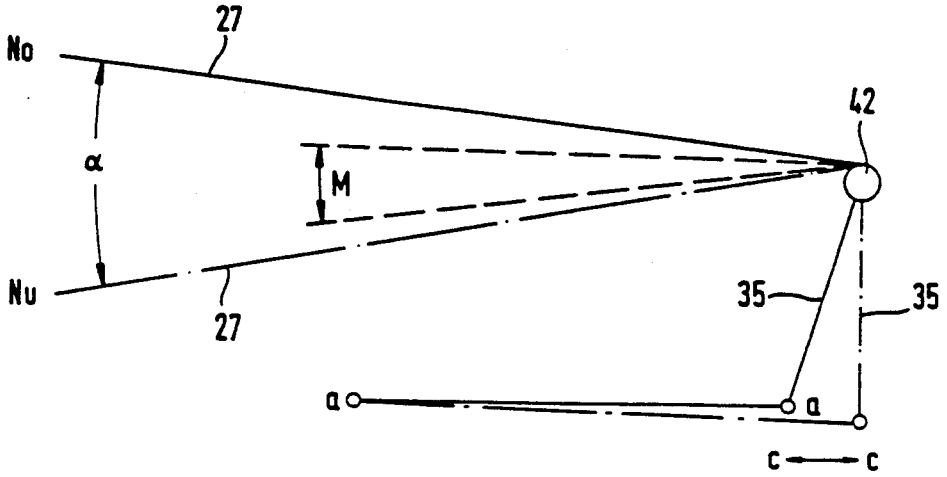
FIG. 4 shows schematically the relation between the tilt angle of the seat and the extension of the helical spring.
Figure 5:
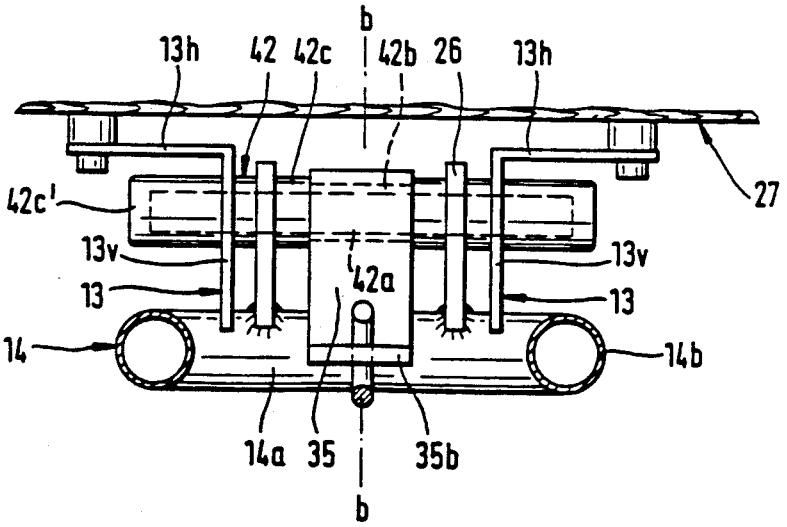
FIG. 5 is a section along the line V—V of FIG. 3.
Figure 6:
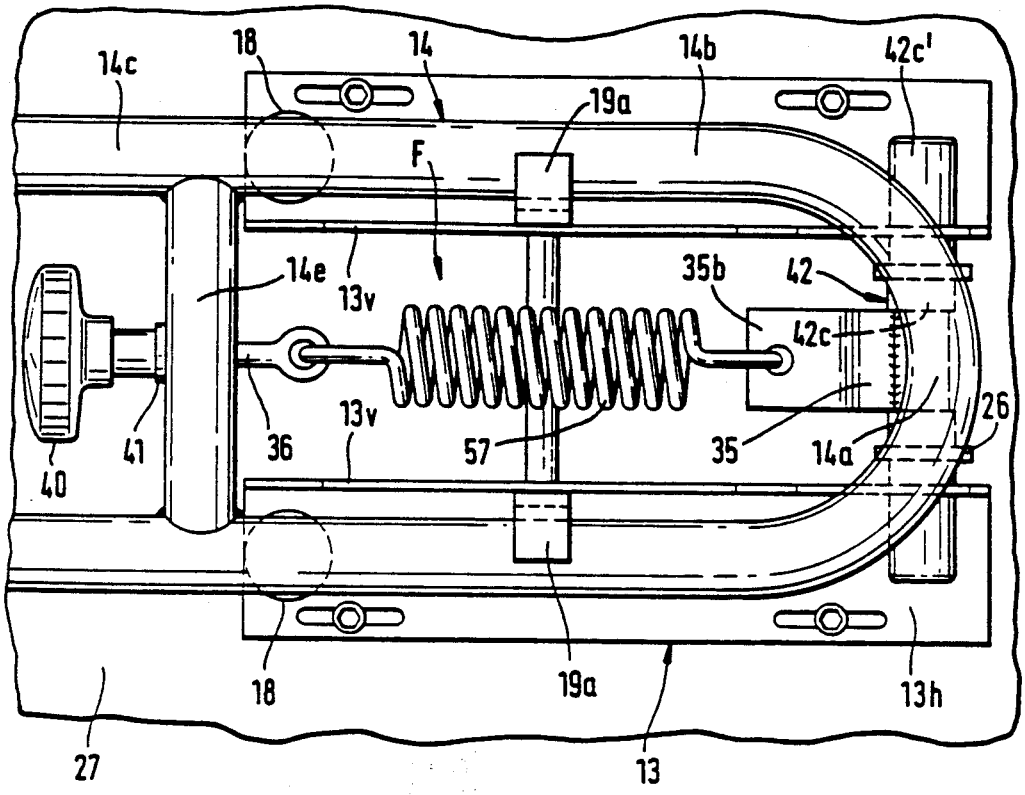
FIG. 6 is an enlarged cutaway portion of the helical spring area in a bottom view.

A seat member 13 is pivotally connected with the arm 14 via a horizontal shaft 42 which is mounted pivotally in the arm 14 close to the knee-support area 27*a* of the seat 27. To this end, swivel bearings 26 are provided which extend through openings in vertically disposed shackles which are secured to the semicircular cross-member of the arm 14. The seat support member 13 consists of two angle sections (shapes), disposed symmetrically to the plane of symmetry b—b and being a mirror image of each other. To the seat 27 are secured horizontal legs 13*h*. Vertical legs 13*v* are each fixed to the adjacent free end of the shaft 42 so that the seat support member 13 forms a rigid, pivotable unit with the shaft 42. The shaft 42 is provided with a radial arm 35. A helical tension spring 57, part of the spring mechanism F, is secured with its rear end to the arm 14 and attached to the arm 35 by means of its hook at a distance from the shaft 42. As shown in FIGS. 3, 5, and 6, the spring 57 is hinged by its rear side to the arm 14. The spring 57 can be prestressed by means of a pre-stressing device which comprises a threaded bolt 36 disposed along the tension axis a—a, the bolt being secured by threaded connection to a pre-stressing nut 40 abutting on a stationary part of the chair. The bolt 36 is provided at its front end with a lug to receive the hook end of the helical spring 57. The pre-stressing nut 40 abuts on a cross-member 14*e* of the arm 14 via a washer 41. The seat 27, inclined backward at a maximum stretch of the spring 57 is pivotable about the shaft 42 over an angle $\alpha$ without difficulty. As shown particularly in FIG. 4, the pre-stressing of the helical spring 57 is adjusted according to the body weight and individual needs and habits of the user so that the seat 27 is held in suspension by the spring 57 within the middle range M of the swivel angle $\alpha$ which range corresponds to a tension different from the maximum stretch c—c of the spring. The axis of tension a—a of the spring 57 is approximately horizontal. The swivel angle $\alpha$, as shown in the drawing, is about 10° and is limited by mechanical detent means.

Elastic buffer elements 18, secured to the horizontal legs 13*h*, are provided in order to limit the pivotal movement of the seat 27 downwards. The upward movement of the seat is limited by means of a shackle 19 secured to a vertical leg 13*v* of the seat support member 13, the shackle being attached by its curved detent end to a tubular member of the arm 14 (FIG. 3). In the course of the pivotal motion, the arm 35 passes through a position in which it is disposed perpendicularly to the axis of tension a—a or it approximates such position at the maximum extension of the helical spring 57. At a minimum extension of the spring, the seat 27 is inclined slightly forward. FIG. 4 shows the extreme upper and lower positions of the seat 27, No and Nu respectively, and the middle range M of the swivel angle $\alpha$. The change of the angle $\alpha$ results in a slight change of the position of the axis a—a. In the example illustrated in FIG. 4, the axis is slightly inclined downward at the maximum extension of the spring.

In the further embodiments shown in FIGS. 7, 8, 9, and 10, the components corresponding in function to the components of the above-described embodiments but differing in form thereform, are designated with the same reference numerals with single or double index mark, e.g. the supporting frame is designated 12 in FIGS. 1–6, 12′ in FIGS. 7, 8 and 12″ in FIG. 9. Both of the further embodiments differ from the first embodiment of FIGS. 1–6 essentially in that the back-rest 28′, 28″ forms, with the seat support member 13, a rigid unit pivotable about the axis 42, as the back-rest is connected to the member 13 by means of a supporting tubular member 61 which is curved by an angle greater than 90°. The lower end portion 61*a* of the tubular member 61, approximately parallel to the seat 27, is axially movable in a bushing 60 and can be secured in various positions by means of a set-screw 64.

The bushing 60 is secured to a mounting plate which is secured by welding to the angular members of the seat support member 13. The upper end portion 61*b* of the supporting tubular member 61 is received in a sleeve 28*a*′ or 28*a*″ of the back-rest 28′ or 28″ and locked at a desired height by means of a set-screw 63. In this case, the pre-stressing device is disposed on the front side of the helical spring 57. To this end, the prestressing nut 40′ is supported on the arm 35′ and the helical spring is hinged on the arm 14 via the cross-member 14*e*. In the embodiment of FIGS. 7, 8, the tubular members of the supporting frame 12′ extend vertically in the adjustment portion 12*c*′ and are curved backwards at their upper ends in a horizontal plane and joined together through a cross-member. In the embodiment of FIG. 9, the tubular members of the supporting frame 12″ in its adjustment portion 12*c*″ are disposed at an acute angle to the vertical and are bent at the end of the adjustment portion 12*c*″ in opposite directions so that they are joined to each other by a cross-member.

The arm 14′, 14″ and the associated bushings 14*d*′, 14*d*″ correspond by the design and function to the arm 14 and bushing 14*d* of the example of FIGS. 1–6. The same also applies to the axis (shaft) 42, which is designed in all embodiments in the same manner (FIGS. 3, 5) as explained below. A spindle 42*a* is mounted directly in the swivel bearings 26. In the axial sections disposed outside the bearings 26, the spindle 42*a* is tightly surrounded by sleeves 42*b* which are fixed securely to the spindle 42*a*. The shaft 42 is secured in an axial position between the vertical legs 13*v* by protective sleeves 42*c* which in turn are fixed to the spindle 42*a* through the sleeves 42*b*.

When a user sits down on the chair, the seat 27 swivels downward from its upper position, indicated as No in FIG. 4, about the axis 42. This results in a corresponding pivotal motion of the arm 35 and corresponding increasing tension of the helical spring 57. The pivotal motion, decreasing the swivel angle, arrives at a standstill approximately in a middle range M of the swivel angle (FIG. 4) due to the increasing tension of the spring 57. In that standstill position, the seat 27 is maintained in suspension inasmuch as the user does not shift considerably his/her centre of gravity through voluntary or involuntary motions. A relatively high pre-stressing of the spring 57 would result in the standstill position falling rather in the upper area of the middle range M. Such a relatively high pre-stressing is most likely to prevent unintentional rocking motions of the seat. At a relatively low pre-stressing, it is easier to bring about a rocking motion of the seat for fun, wherein the rocking motion may be achieved in a greater angular range; as a rule, the extremem lower inclination of the seat, Nu, is not reached.

I claim:

1. A chair, especially for children and teenagers, comprising a seat having a knee-support area;

a plurality of substantially horizontal legs extending radially from a vertical axis, said horizontal legs being provided with casters for resting said chair on a floor;

a supporting frame secured to said horizontal legs, said supporting frame comprising a horizontally extending portion disposed close to said floor at a distance therefrom determined by the heights of said horizontal legs and said casters; and a vertically extending portion having an adjustment section, the angle between the horizontally and vertically extending portions of said supporting frame being not greater than about 90°;

a back-rest attached to the vertically extending portion of said supporting frame;

a substantially horizontal support arm adjustably mounted on said supporting frame at the adjustment section thereof and extending toward the knee-support area of said seat, the height of said support arm above said horizontal legs being adjustable;

a horizontal shaft pivotably mounted on said support arm and extending in the direction transverse to the direction in which said support arm extends, said horizontal shaft being located near the knee-support area of said seat and having a radial arm;

a tiltable seat support member attached to said seat and to said horizontal shaft, said seat support member being rotatable about said shaft through a predetermined swivel angle;

a spring mechanism including a single helical tension spring, disposed substantially horizontally along a tension axis, having one end attached to the radial arm of said horizontal shaft and the other end to said support arm, said spring mechanism suppressing the tilting of said seat support member when said swivel angle is decreased and stimulating the tilting of said seat support member when said swivel angle is increased;

detent means for limiting the magnitude of said swivel angle; and means for prestressing said helical tension spring, said means being adjustable as a function of the weight on said seat, whereby said swivel angle is limited to a predetermined middle range within the range determined by said detent means.

2. A chair according to claim 1 wherein said support arm has a U-shape and is adjustably secured to the adjustment section of said supporting frame by busings, and wherein said swivel angle is limited by said detent means to approximately 10°.

3. A chair according to claim 1 wherein said backrest forms a rigid unit with said seat support member.

4. A chair according to claim 2 wherein said backrest forms a rigid unit with said seat support member.

5. A chair according to claim 1 wherein, when said tension spring is at its maximum extension, said radial arm is positioned normal to said tension axis; and wherein, when said tension spring is at its minimum extension, said seat is inclined forward.

6. A chair according to claim 2 wherein, when said tension spring is at its maximum extension, said radial arm is positioned normal to said tension axis; and wherein, when said tension spring is at its minimum extension, said seat is inclined forward.

7. A chair according to claim 3 wherein, when said tension spring is at its maximum extension, said radial arm is positioned normal to said tension axis; and wherein, when said tension spring is at its minimum extension, said seat is inclined forward.

8. A chair according to claim 4 wherein, when said tension spring is at its maximum extension, said radial arm is positioned normal to said tension axis, and wherein, when said tension spring is at its minimum extension, said seat is inclined forward.

9. A chair according to claim 1 which further comprises a pre-stressing device for pre-stressing said tension spring, said pre-stressing device comprising a threaded bolt and a pre-stressing nut engaging said bolt and abutting on said support arm, said bolt and nut extending along said tension axis.

10. A chair according to claim 5 which further comprises a pre-stressing device for pre-stressing said tension spring, said pre-stressing device comprising a threaded bolt and a pre-stressing nut engaging said bolt and abutting on said support arm, said bolt and nut extending along said tension axis.

11. A chair according to claim 1 which further comprises pivotal bearings fastened to said support arm and supporting said horizontal shaft, said chair further comprising a pair of symmetrically disposed angular sections having vertical legs for securely attaching said seat support member to said shaft.

12. A chair according to claim 2 which further comprises pivotal bearings fastened to said support arm and supporting said horizontal shaft, said chair further comprising a pair of symmetrically disposed angular sections having vertical legs for securely attaching said seat support member to said shaft.

13. A chair according to claim 3 which further comprises pivotal bearings fastened to said support arm and supporting said horizontal shaft, said chair further comprising a pair of symmetrically disposed angular sections having vertical legs for securely attached said seat support member to said shaft.

14. A chair according to claim 4 which further comprises pivotal bearings fastened to said support arm and supporting said horizontal shaft, said chair further comprising a pair of symmetrically disposed angular sections having vertical legs for securely attaching said seat support member to said shaft.

15. A chair according to claim 5 which further comprises pivotal bearings fastened to said support arm and supporting said horizontal shaft, said chair further comprising a pair of symmetrically disposed angular sections having vertical legs for securely attaching said seat support member to said shaft.

16. A chair according to claim 6 which further comprises pivotal bearings fastened to said support arm and supporting said horizontal shaft, said chair further comprising a pair of symmetrically disposed angular sections having vertical legs for securely attaching said seat support member to said shaft.

17. A chair according to claim 7 which further comprises pivotal bearings fastened to said support arm and supporting said horizontal shaft, said chair further comprising a pair of symmetrically disposed angular sections having vertical legs for securely attaching said seat support member to said shaft.

18. A chair according to claim 8 which further comprises pivotal bearings fastened to said support arm and supporting said horizontal shaft, said chair further comprising a pair of symmetrically disposed angular sections having vertical legs for securely attaching said seat support member to said shaft.

* * * * *